US008162505B2

(12) United States Patent
Claerhout et al.

(10) Patent No.: US 8,162,505 B2
(45) Date of Patent: Apr. 24, 2012

(54) LIGHTING DEVICE

(76) Inventors: Xaveer Claerhout, Sijsele-Damme (BE); Barbara Van Biervliet, Sijsele-Damme (BE)

( * ) Notice: Subject to any disclaimer, the term of this patent is extended or adjusted under 35 U.S.C. 154(b) by 370 days.

(21) Appl. No.: 12/310,504

(22) PCT Filed: Sep. 7, 2007

(86) PCT No.: PCT/EP2007/007834

§ 371 (c)(1),
(2), (4) Date: Feb. 26, 2009

(87) PCT Pub. No.: WO2008/028679

PCT Pub. Date: Mar. 13, 2008

(65) Prior Publication Data

US 2010/0002442 A1 Jan. 7, 2010

(30) Foreign Application Priority Data

Sep. 8, 2006 (BE) ..... 2006/0460

(51) Int. Cl.
*F21V 21/15* (2006.01)

(52) U.S. Cl. ..... 362/225; 362/249.09; 362/286

(58) Field of Classification Search ..... 362/325, 362/249.07, 249.09, 285, 286, 288, 289, 362/362

See application file for complete search history.

(56) References Cited

U.S. PATENT DOCUMENTS

| | | | | |
|---|---|---|---|---|
| 5,774,273 | A * | 6/1998 | Bornhorst | 359/665 |
| 6,357,893 | B1 * | 3/2002 | Belliveau | 362/285 |
| 2002/0093823 | A1 * | 7/2002 | Rohlfing et al. | 362/288 |
| 2008/0013317 | A1 * | 1/2008 | Hinds | 362/286 |

FOREIGN PATENT DOCUMENTS

FR 949573 9/1949

* cited by examiner

*Primary Examiner* — David V Bruce
(74) *Attorney, Agent, or Firm* — James Creighton Wray

(57) ABSTRACT

The invention relates to a lighting device (1*a*, 1*b*, 1*c*, 1*d*), comprising—one or more light sources (2, 21); and—one or more housing elements (3) that are disposed so as to be movable relative to said light source(s) (2, 21), the movement of the said housing elements (3) being achieved by means of deformation of said housing elements (3); wherein the deformation of one or more housing elements (3) is controlled by means of one or more actuators (4*a*, 4*b*).

15 Claims, 8 Drawing Sheets

LIGHTING DEVICE

This application claims the benefit of Belgian Application No. 2006/0460 filed Sep. 8, 2006 and PCT/EP2007/007834 filed Sep. 7, 2007, which are hereby incorporated by reference in their entirety.

The invention relates to a lighting device, comprising one or more light sources; and one or more housing elements that are disposed so as to be movable relative to said light source(s), the movement of the abovementioned housing elements being achieved by means of deformation of said housing elements.

Until now, the lighting fittings market has always been practically completely dominated by static lighting fittings (in this patent application, the terms lighting fitting and lighting device are synonyms). From the time that the electric light bulb was invented, people have been searching to move or direct the light source in one or the other easy way by means of the lighting fitting. The manually directable lighting fittings that in the meantime exist in an infinitely large number of forms and variants are so far the best examples thereof.

Since the beginning of the last century the first patent applications, as described further below, have shown that people have also been trying to provide lighting fittings that have a movement dimension. A large varied lighting fittings market in which a movement dimension of the lighting device is the most important feature has also developed in the meantime.

A first category is patent applications with the aim of making the light source in the lighting device or the light beams themselves move in a certain lighting device, in order to obtain a certain directed light emission or light effect in this way. This is applicable in the lighting of, for example, discotheques or for directing motor car headlamps, as described in Canadian Patent Application 2172357 or European Patent Application No. 0860650.

In CA 2172357 a lighting system is disclosed, comprising a laser light generator and a series of motor-driven mirrors, which are directed in such a way that they deflect a laser light beam in different directions in order to create a light show.

In EP 0860650, a lighting device such as a headlamp of a motor vehicle is disclosed, comprising a thin transparent plate in which a number of microlenses arranged in a matrix are integrated, and comprising a second thin transparent plate which is supported so as to be movable relative to the first plate by means of at least one pair of flexures, a number of microlenses arranged in a matrix also being integrated in the second plate.

However, in the case of such lighting devices the aim is to be able to manipulate the light source and its light effect, but the object is not intended to achieve a deformation or a movement of the lighting device per se or certain parts of said lighting device. The deformation or movement of the lighting fitting or certain parts of it is purely a means for obtaining the desired light effect, and is not an aim pertaining to shape per se.

A second category consists of covering or protecting the light source of the lighting device by a structure that is slid in front of the light source. However, the aim of this category is merely to protect or screen off the light source behind it, without providing any other shape movement on it.

So, for example, in EP 0107900 a lamp such as a fog lamp for a vehicle is disclosed, which is provided with a housing that is provided for mounting a series of parallel louvers. The louvers are controlled by a heat-driven actuator. When this is heated up, the actuator serves to pivot the louvers into an open position. When the lamp has been deactivated, the actuator stops the heating, and the louvers close automatically in order to protect the lens by means of a spring as the actuator cools down.

A third category consists of lighting devices wherein certain parts of the lighting device assume a different shape when the light source is switched on. It is typical here to use bimetal that deforms through the heat given off by the light source and through that deformation sets the lamp itself or parts of the lighting fitting in motion. The housing of such lighting devices is consequently controlled by means of the heat of the light source itself, which makes said housing open, for example, or makes it close when it cools down. Such a lighting device can be used, for example, for imitating a flower. When the light is off, the leaves of the flower are folded up, and when the light source is switched on, deformation of the bimetal will make the leaves open, so that said leaves form a flower.

So for example in DE 434397, an artificial flower is disclosed that is combined with a lighting element, wherein the petals or plant leaves are made of a heat-sensitive material, such as a bimetal, wherein the shape or arrangement changes through the effect of the heat source.

The disadvantage of such lighting devices, however, is that because of the fact that movement occurs only through the heating of the bimetal, the applications and the shape possibilities are limited. A further disadvantage is that the movement of the bimetal depends on the heat that the light source of the lighting device gives off, so that the activating element of the bimetal always has to be placed close to the light source. Light sources that give off less heat will therefore cause less deformation of the bimetal, and will consequently produce less deformation of the lighting device. For example in the case of modern low-energy light bulbs or LED lighting, which give off little or almost no heat, this bimetal concept is of little use.

The object of the invention is to provide a lighting device according to the preamble of claim 1, wherein the deformation of one or more housing elements can occur irrespective of the distance from the light sources and the type of light source, in order to be able to achieve a large number of applications, such as, inter alia, also with LED lighting or low-energy light bulb lighting and all other types of lighting.

The object of the invention is achieved by providing a lighting device, comprising one or more light sources; and one or more housing elements that are disposed so as to be movable relative to said light source(s), the movement of the abovementioned housing elements being achieved by means of deformation of said housing elements;

wherein the deformation of the one or more housing elements is controlled by means of one or more actuators.

The one or more actuators used are elements that are small but powerful and through external influence such as, inter alia, electric current, perform a 2-dimensional or 3-dimensional movement with a certain force and at a certain speed. This movement is launched against the material to be deformed, which slowly deforms as a result until the movement of the actuator has ended, and the deformation therefore also comes to a standstill at a certain point. This gradual deformation has the advantage that there are no abrupt movements that can give rise to damage or breakage of one or more parts of the lighting device or danger for the user.

In this way a lighting device is obtained wherein the deformation of one or more housing elements can be achieved irrespective of the distance from the light sources and the type of light source, in order to be able to achieve a large number of uses such as, inter alia, also with LED lighting or lighting of an energy-saving light bulb, and all other types of lighting.

In a first preferred embodiment of a lighting device according to the invention, one or more power sources are provided for activating the actuator(s) and for switching on the one or more light sources, these one or more power sources being the same.

In this case a relay can be provided for enabling the actuator(s) to go into operation a certain time before or after activation of the actuator(s).

In a second preferred embodiment of a lighting device according to the invention, one or more power sources are provided for activating the actuator(s) and for switching on the one or more light sources, these one or more power sources being different.

It is preferable here for the one or more power sources that are provided for activating the said actuator(s) to be put into operation at a time to be set.

This putting into operation of the one or more power sources that are provided for activating the said actuator(s) can run according to a certain previously set cycle here.

In an advantageous embodiment of a lighting device according to the invention, the one or more actuators are provided for performing a return movement of the one or more housing elements to their original shape.

The one or more housing elements can also be made of a material that has the property that it automatically at least partially returns to its original shape after deformation. This has the advantage that the return movement is a natural movement that is unforced and is safe.

In order to support the return movement of the said one or more housing elements, it is possible to provide, for example, a spring system, a counterweight or a magnetic system, or any other part or system by means of which the same object is achieved.

In a preferred embodiment of a lighting device according to the invention, the one or more actuators are provided for performing a 2-dimensional and/or 3-dimensional movement, said 2-dimensional and/or 3-dimensional movement of the one or more actuators providing a 2-dimensional and/or 3-dimensional deformation of the one or more housing elements.

The one or more actuators can be selected, inter alia, from thermal actuators, pneumatic actuators, hydraulic actuators, three-dimensional actuators, electric motors, step motors, piezoelectric translators or linear actuators. However, other types of actuators can also be used.

If thermal actuators are provided, a mechanism leaving some space for motion is preferably provided for preventing premature deformation of the one or more housing elements by a premature movement of the one or more actuators by means of environmental heat.

It is preferable to have thermal actuators, more preferably of the wax motor type.

Thermal actuators are small, powerful and easy to fit, and give a gradual movement. Thermal actuators of the wax motor type have the following advantages:

- they are small, and therefore easy to incorporate in the lighting devices;
- they are available at reasonable prices, so that the production costs of the lighting device can be kept relatively low;
- the deformation of certain parts of the lighting device by thermal actuators of the wax motor type is noiseless and slow. The dynamic factor is consequently visible and controllable;
- the deformation of certain parts of the lighting device driven by the thermal actuators of the wax motor type can be completely separated from activity or inactivity of the light source itself, so that the lighting devices in shop window displays, for example, move according to a certain pattern in interaction with the light sources themselves.
- the deformation of certain parts of the lighting device driven by the thermal actuator(s) of the wax motor type can in many cases return to the initial position on the basis of the elastic qualities of the one or more driven housing elements of the lighting device or the force of gravity or an interposed spring, a counterweight or a magnetic system or any other part or system for achieving this return;
- if a piston of a returning thermal actuator on cooling down or deactivation is not connected to the returning or deforming parts described in the item above, this has the advantage that safety can be controlled better.

In a preferred embodiment of a lighting device according to the invention a plurality of actuators is provided in order to

- reinforce a certain deformation of the one or more housing elements by increasing the force of the actuator(s); and/or
- make the deformable housing elements deform over a greater distance by, for example, connecting various actuators to each other in series (which could be useful, for example, in larger fittings); and/or
- deform one or more of the housing elements of the lighting device in order to obtain a tilting moment that causes a series of connected housing elements to deform (which could be used, for example in a lighting device in which the deformation of one part sets in motion the deformation of a following part, like in a domino arrangement): and/or
- lock and unlock a certain position of the housing elements of the lighting device (which could be useful for ensuring that the deformed housing elements are blocked in a deformed state, so that the actuator which brought about the deformation does not have to work constantly for so long as the deformed state is being maintained); and/or
- harmonize the deformation of the housing elements; and/or
- make the deformation cycles of the various housing elements run according to their own rhythm (which could be used in a shop window display, for example, in order to obtain a sort of wave movement in the deformation of the parts).

The lighting device according to the invention can as well be of the type built-in lighting fitting, standing lighting fitting, suspended lighting fitting or floating lighting fitting. However, other forms of lighting fittings are possible as well.

In order to explain the features of this invention further, and in order to indicate additional advantages and details of it, there now follows a more detailed description of the lighting device according to the invention and a number of exemplary embodiments according to this invention. It should be clear that nothing in the description that follows can be interpreted as a limitation of the protection for the lighting device according to the invention applied for in the claims.

Furthermore, a number of these embodiments are discussed in the appended figures, wherein reference is made to these figures by means of reference numerals, wherein

DETAILED DESCRIPTION OF THE PREFERRED EMBODIMENTS

A lighting device (1*a*, 1*b*, 1*c*, 1*d*) according to the invention, as shown in FIGS. 1 to 10, 13 and 14, comprises one or more light sources (2, 21); and one or more housing elements (3) that are disposed so as to move relative to said light sources (2, 21), the movement of the abovementioned housing elements (3) being achieved by means of deformation of said housing elements. With housing elements (3) the complete housing as well as any other part of said housing are meant.

The deformation of said one or more housing elements (3) is herewith controlled by means of one or more actuators (4*a*, 4*b*) (see FIGS. 5 and 6, 11 and 12). With an actuator (4*a*, 4*b*) a device is meant that converts an input signal (generally an electrical signal) into a movement.

Furthermore, one or more power sources (not shown in the figures) are provided for activating the one or more actuators (4*a*, 4*b*), and for switching on the one or more light sources (2, 21). Said power sources can either be the same, so that the one or more actuators (4*a*, 4*b*) go into operation at the same time, or the actuator(s) (4*a*, 4*b*) can be put into operation by means of a relay a certain time before or after activation of the actuator(s) (4*a*, 4*b*). The power source(s) can, however, also be selected so as to be different, and consequently in the form of a separate power circuit, which puts the one or more actuators into operation at a set time. The putting into operation of these one or more power sources for activation of the one or more actuators (4*a*, 4*b*) can therefore be performed according to a certain preset cycle.

Figure 1:
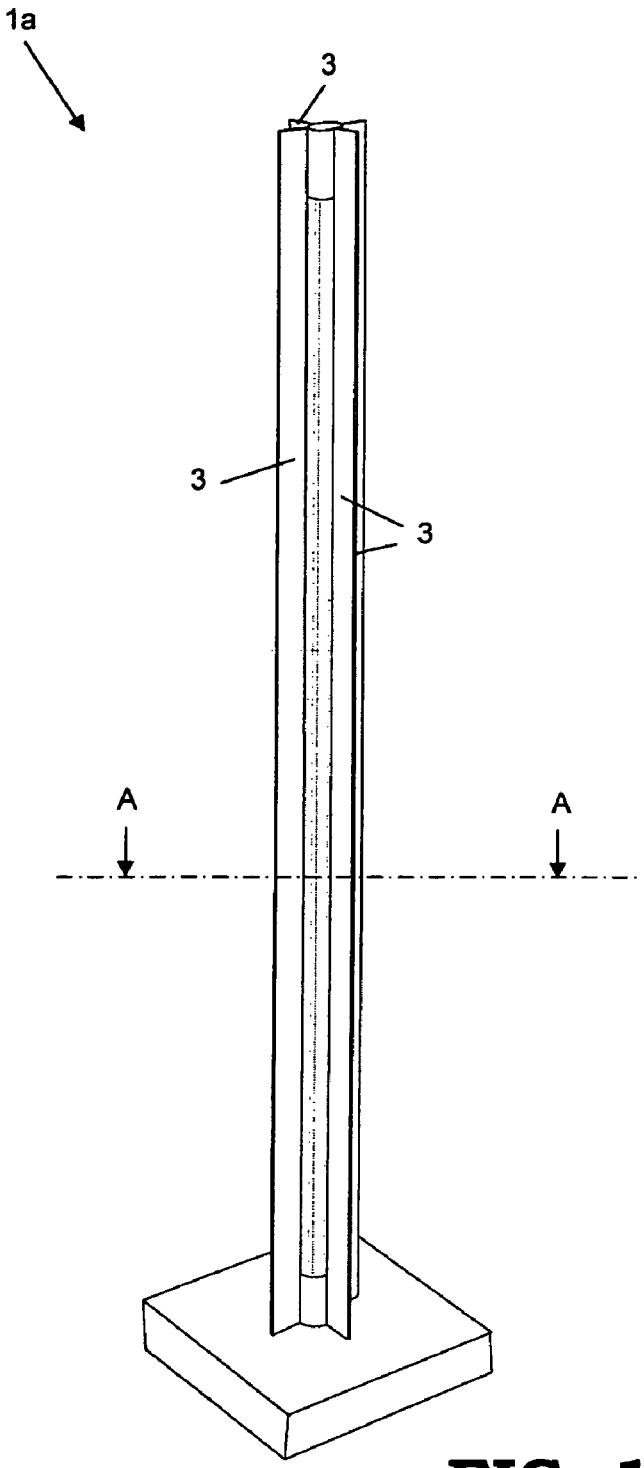
FIG. 1 is a first exemplary embodiment of a lighting device according to the invention, in a non-active state.
Figure 2:
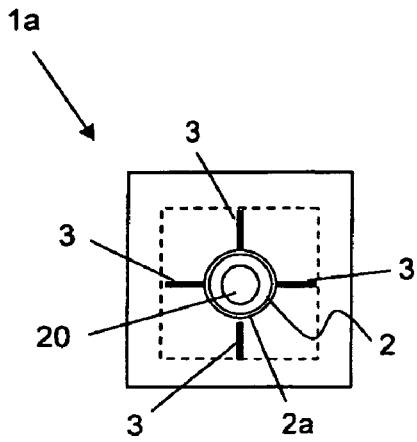
FIG. 2 is a cross section along line A-A as shown in FIG. 1.
Figure 3:
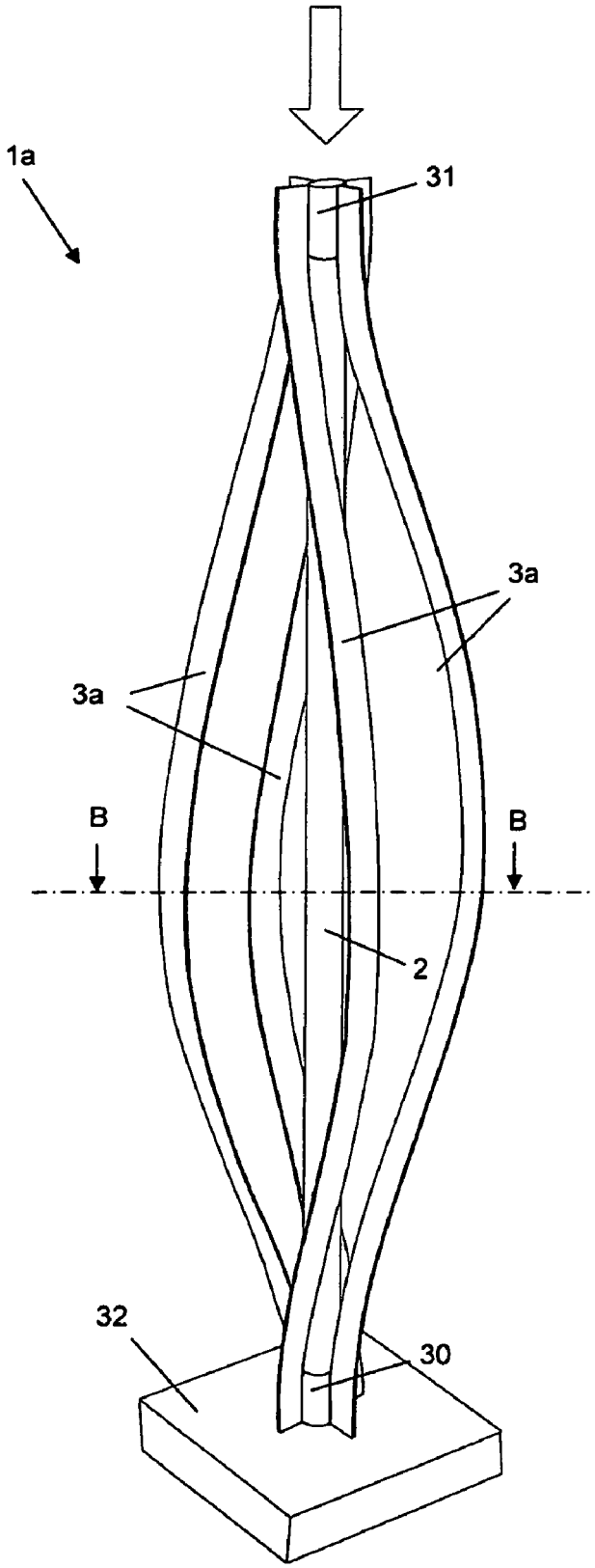
FIG. 3 is a first exemplary embodiment of a lighting device according to the invention, in an active state.
Figure 4:
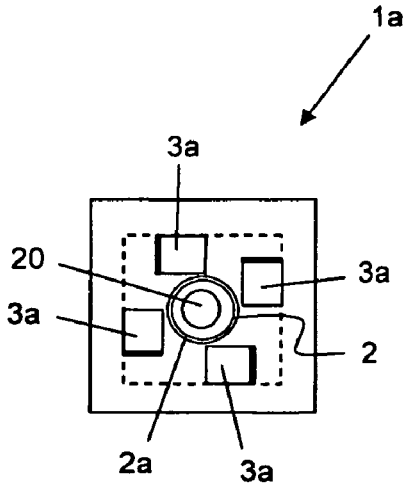
FIG. 4 is a section along line B-B as shown in FIG. 3.
Figure 5:
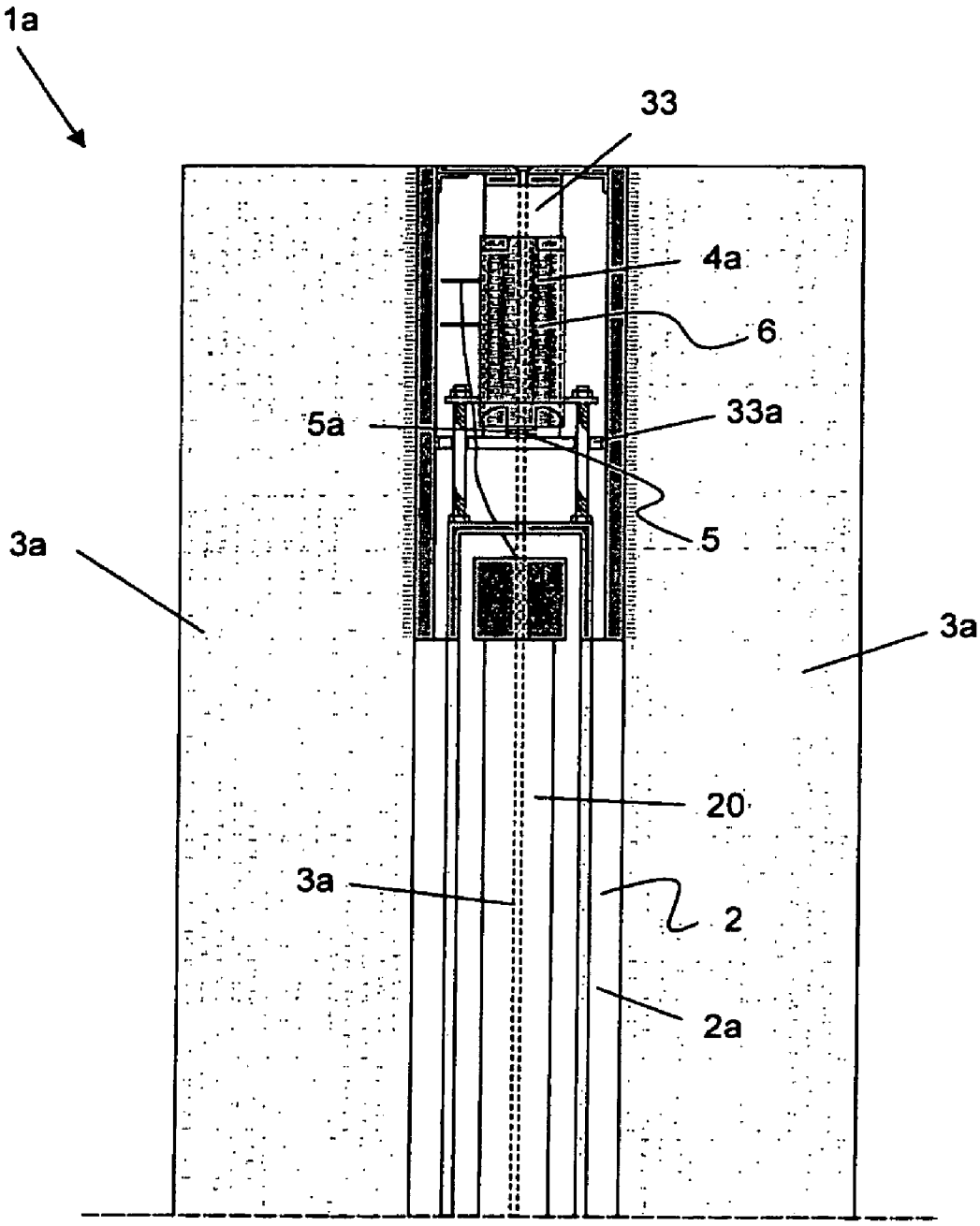
FIG. 5 is a cross section of the lighting device as shown in FIG. 1.
Figure 6:
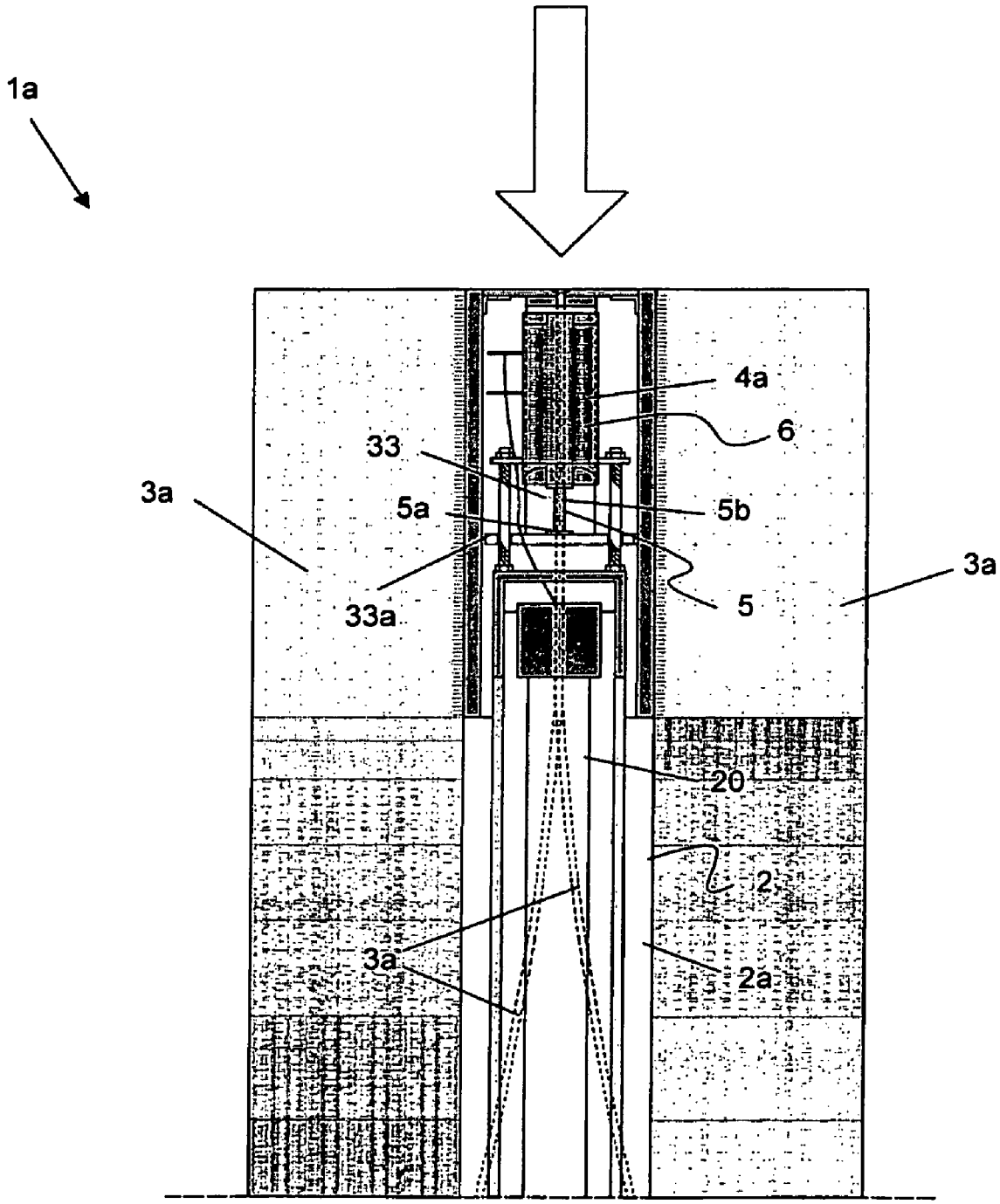
FIG. 6 is a cross section of the lighting device as shown in FIG. 3.
Figure 11:
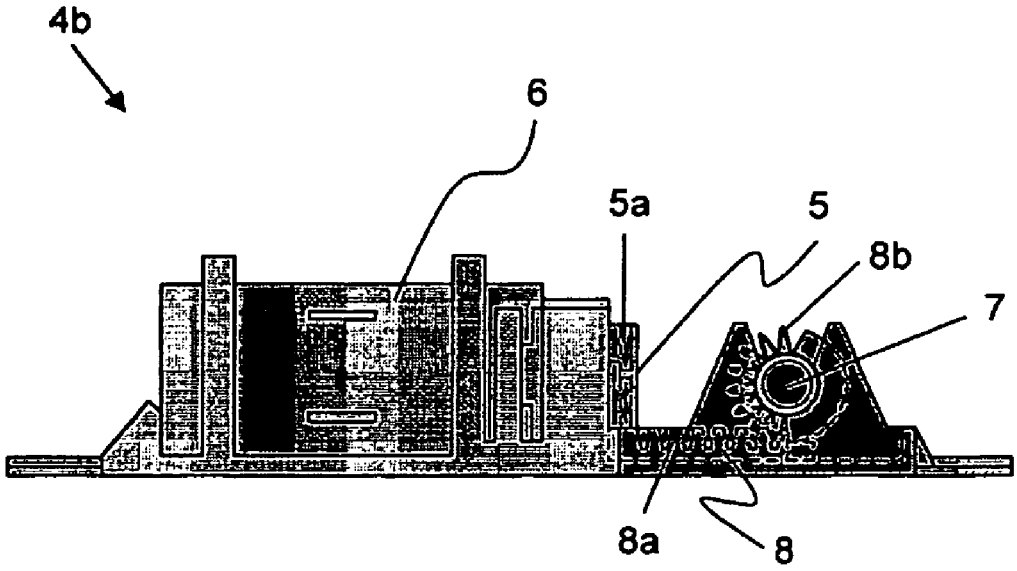
FIG. 11 is a side view of an actuator that converts a linear movement of the piston into a rotary movement of a shaft, the piston being in a retracted position.
Figure 12:
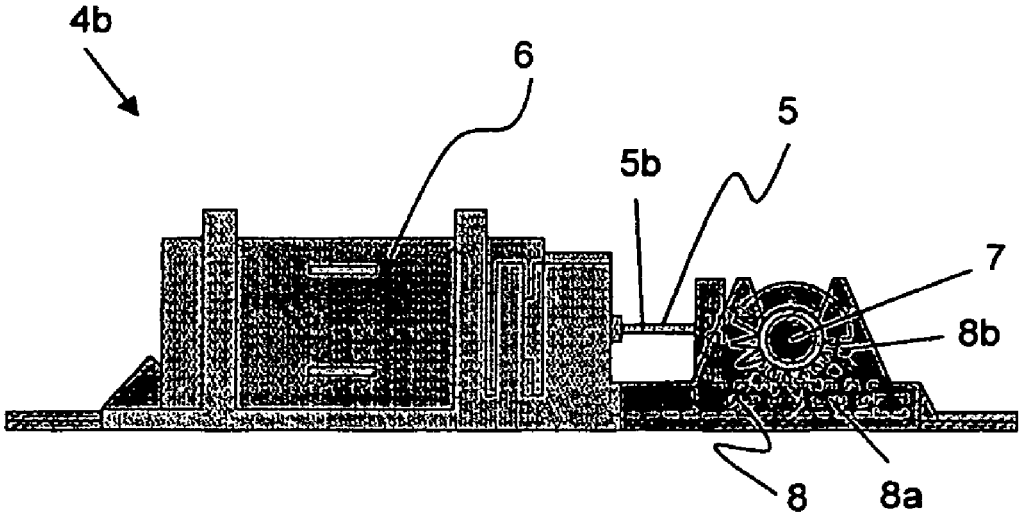
FIG. 12 is a side view of an actuator as shown in FIG. 11, the piston being in an extended position.

The said one or more actuators (4*a*, 4*b*), one exemplary embodiment of which is shown in FIGS. 5 and 6, and in FIGS. 11 and 12, are provided so that they can extend linearly over a certain distance by means of a piston (5), which can move into and out of the housing (6) of the actuator (4*a*, 4*b*) between a retracted position, wherein only the head of the piston (5*a*) is visible, and an extended position, wherein at least a part of the rod (5*b*) of the piston is also visible. This linear movement is performed over a certain distance with a certain external force and at a certain speed. The external force occurs according to a certain curve and is dependent upon the environmental factors, such as the ambient temperature. The linear movement of the actuator (4*a*, 4*b*) as shown in FIGS. 5 and 6, and FIGS. 11 and 12, can be either a pushing or a pulling movement obtained by the external force.

The actuator (4*b*) as shown in FIGS. 11 and 12, is connected to a shaft (7) by means of a toothed wheel system (8). The toothed wheel system (8) is composed of a toothed bar (8*a*), the head of the piston (5*a*) being connected to said toothed bar (8*a*), and a toothed wheel (8*b*), a tooth system being provided at least over a part of said toothed wheel (8*b*), and the teeth of the toothed bar (8*a*) extending between the teeth of the toothed wheel (8*b*). When the piston (5) is retracted and extended, a rotation movement of the shaft (7) is consequently obtained. The lighting device (la, 1*b*, 1*c*, 1*d*) according to the invention is therefore designed in such a way that the movement of the one or more actuator(s) (4*a*, 4*b*) deforms one or more housing elements (3*a*, 3*b*, 3*c*, 3*d*) by means of a linear movement (see the actuator (4*a*) as shown in FIGS. 5 and 6) or a rotating movement (see the actuator (4*b*) as shown in FIGS. 11 and 12).

The one or more actuators (4*a*, 4*b*) can be provided for performing a return movement of the one or more deformed housing elements (3*a*, 3*b*, 3*c*, 3*d*) to their original shape. Said return movement is more specifically achieved by a thrusting or a returning movement of the one or more pistons (5) of the actuators (4*a*, 4*b*). The return movement of the housing elements (3*a*, 3*b*, 3*c*) can, however, also be achieved by the force of gravity or the inherent resilience of the deformed material, which has the property that it at least partially returns automatically to its original shape. In order to support this abovementioned return movement, a spring system, a counterweight or a magnetic system (not shown in the figures) or another part or system can be provided for achieving the same purpose.

The provision of a plurality of actuators (4*a*, 4*b*) can serve to:

reinforce a certain deformation of the one or more housing elements (3*a*, 3*b*, 3*c*, 3*d*) by increasing the force of the actuator(s) (4*a*, 4*b*); and/or make the deformable housing elements deform over a greater distance by, for example, connecting various actuators (4*a*, 4*b*) to each other in series; and/or deform one or more of the housing elements of the lighting device in order to obtain a tilting moment that causes a series of connected housing elements to deform; and/or lock and unlock a certain position of the housing elements (3*a*, 3*b*, 3*c*, 3*d*) (which could be useful for ensuring that the deformed housing parts are blocked in a deformed state, so that the actuator that has brought about the deformation does not have to work constantly for so long as the deformed state is being maintained); and/or harmonize the deformation of the housing elements (3*a*, 3*b*, 3*c*, 3*d*); and/or make the deformation cycles of the various housing elements (3*a*, 3*b*, 3*c*, 3*d*) run according to their own rhythm.

The one or more actuators can be selected, inter alia, from thermal actuators, pneumatic actuators, hydraulic actuators, three-dimensional actuators, electric motors, step motors, piezoelectric translators or linear actuators. However, other types of actuators can also be used. If thermal actuators (4*a*, 4*b*) are provided, a mechanism leaving some space for motion can be provided in order to avoid premature deformation of the one or more housing elements (3*a*, 3*b*, 3*c*, 3*d*) by a premature movement of the one or more actuators (4*a*, 4*b*) by means of ambient heat. As already described above, thermal actuators of the wax motor type are preferred.

The lighting device (1*a*, 1*b*, 1*c*, 1*d*) according to the invention can be of the built-in lighting fitting type, standing lighting fitting type, suspended lighting fitting type, floating lighting fitting type or any other kind of lighting fitting.

Furthermore, it is optionally also possible to make provision that, in addition to the provision of deformable housing elements (3*a*, 3*b*, 3*c*, 3*d*) in the lighting device (1*a*, 1*b*, 1*c*, 1*d*) according to the invention, one or more light sources (2, 21) themselves can be moved, or even the complete lighting device (1*a*, 1*b*, 1*c*, 1*d*) can be moved. This can be achieved, for example, by having the light source(s) (2, 21) connected to the deforming housing elements (3*a*, 3*b*, 3*c*, 3*d*), so that when the deformation occurs through activation of the actuators (4*a*, 4*b*), the light sources (2, 21) themselves also move. This can also be achieved by, for example, making the light sources (2) integral with the deformable housing elements (3*a*, 3*b*, 3*c*, 3*d*) (for example, by means of LED tube lighting or other lighting).

EXAMPLES

Example 1

The lighting device (1*a*) as shown in FIGS. 1 to 4 is a standing lighting fitting provided with one light source (2). The light source (2) here consists of a hollow translucent rigid tube (2*a*) (made of plastic or glass), an elongated lamp (20), for example a fluorescent lamp, being fitted inside said tube (2*a*). The wiring of the supply and control of the light source (2) and actuators (4*a*), by means of different or separate power sources (see FIGS. 5 and 6), are also fitted inside said tube (2*a*). Said wiring can also extend in a separate casing provided inside said tube (2*a*) (not shown in the figures).

The housing elements (3*a*) consist of four longitudinal strips (for example, made of steel) disposed in a cross shape, which housing elements are fixed both at the top and at the bottom to a starting piece and an end piece (30, 31). The light source (2) extends between said longitudinal strips (3*a*). After the lighting fitting (1*a*) has been switched on, said strips will assume a deformed, bent state, so that the light source (2) gradually can be seen better and/or in a different way. The starting piece (30) is fixed at the bottom to a base plate (32), which can also at the same time possibly contain the transformer needed to provide the light source (2) itself with power. The light source (2) is also fixed at the bottom to the starting piece (30), and thus also the base plate (32) (not shown in the figures), and at the same time, as already stated above, in addition to the transformer that may or may not be required for the light source (2), comprises the wiring of the supply and control of the light source (2) and actuators (4*a*) (see FIGS. 5 and 6).

The four longitudinal strips (3*a*) in the case of the lighting device (la) shown in FIGS. 1 to 6 are controlled by one actuator (4*a*), which is provided so that it carries out a linear movement. As can be seen in FIGS. 5 and 6, a bracket (33) is fixed on the upper side of the end piece (31), which bracket has guide apertures in the bottom plate of the bracket. The linear actuator (4*a*) is fixed on the hollow rigid tube (2*a*) of the light source (2) by means of rods that project through the guide apertures in the bottom plate (33*a*) of the bracket (33). On activation of the actuator (4*a*) and/or the light source (2), the advancing piston (5) of the actuator (4*a*) will press against the bottom plate of the bracket (33), so that pressure is exerted upon the longitudinal strips (3*a*) connected to the end piece. By means of this pressure, the longitudinal strips (3*a*) are forced to assume a bent state, since the underside of the tube (2*a*) is fixed to the base plate (32). After deactivation of the actuator (4*a*), the piston (5) of said actuator (4*a*) will be retracted, so that the longitudinal strips (3*a*), on the basis of their natural material resilience, will return to their initial position. Since the piston (5) is retracted gradually, the return movement of the longitudinal strips (3*a*) will also occur equally gradually. If the return movement of the longitudinal strips (3*a*) is accidentally blocked, the piston (5) will still return without pulling on the longitudinal strips (3*a*), which is an advantage as regards safety during closure.

Example 2

Figure 7:
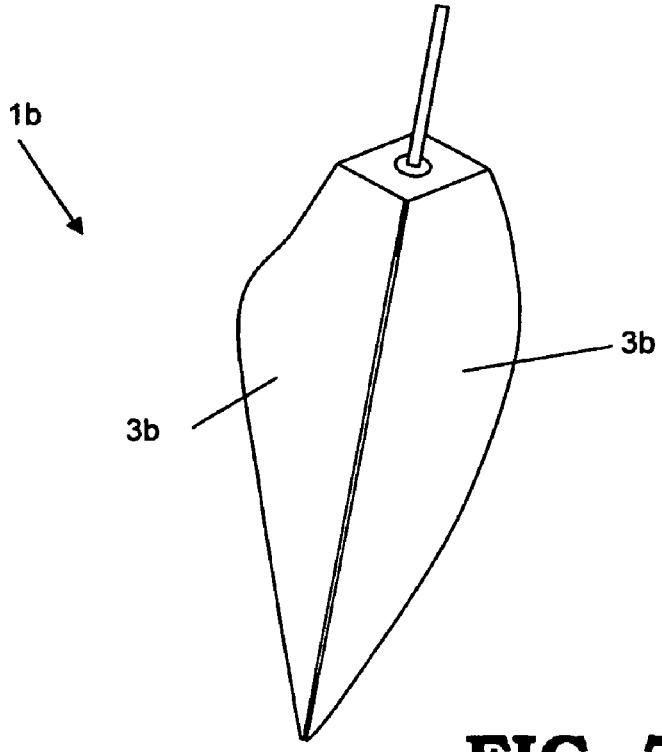
FIG. 7 is a second exemplary embodiment of a lighting device according to the invention, in a non-active state.
Figure 8:
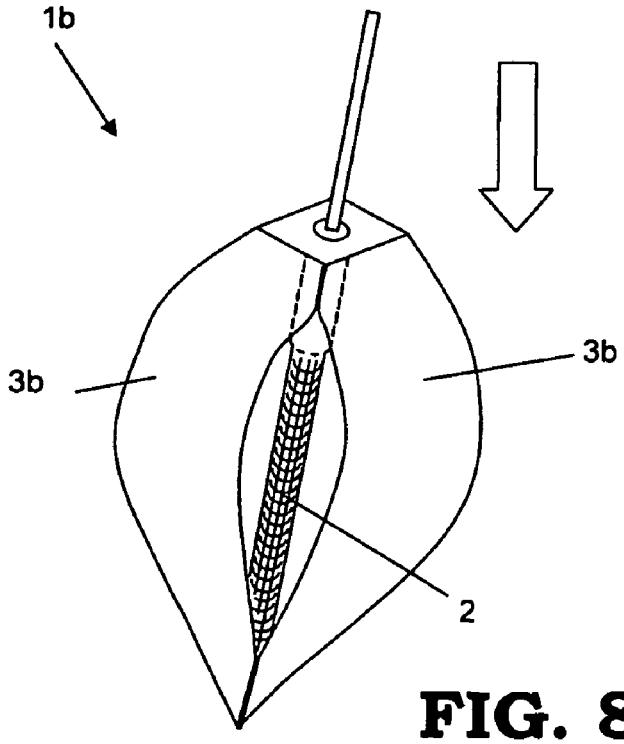
FIG. 8 is a second exemplary embodiment of a lighting device according to the invention, in an active state.

In FIGS. 7 and 8 the lighting device (1*b*) is a suspended lighting fitting provided with one light source (2) of the type described in example 1. The deformable housing elements (3*b*) are leaf-shaped and completely enclose the light source (2). Since the pressure-resistant (rigid) tube (2*a*) is connected to the leaf-shaped deformable housing elements (3*b*), and since the leaf-shaped deformable housing elements (3*b*) are partially connected to each other at the bottom, pressure can be exerted with an actuator (4*a*) upon the leaf-shaped deformable housing elements, so that the latter are bent outwards, with the result that the light source (2) can be seen better.

Example 3

Figure 9:
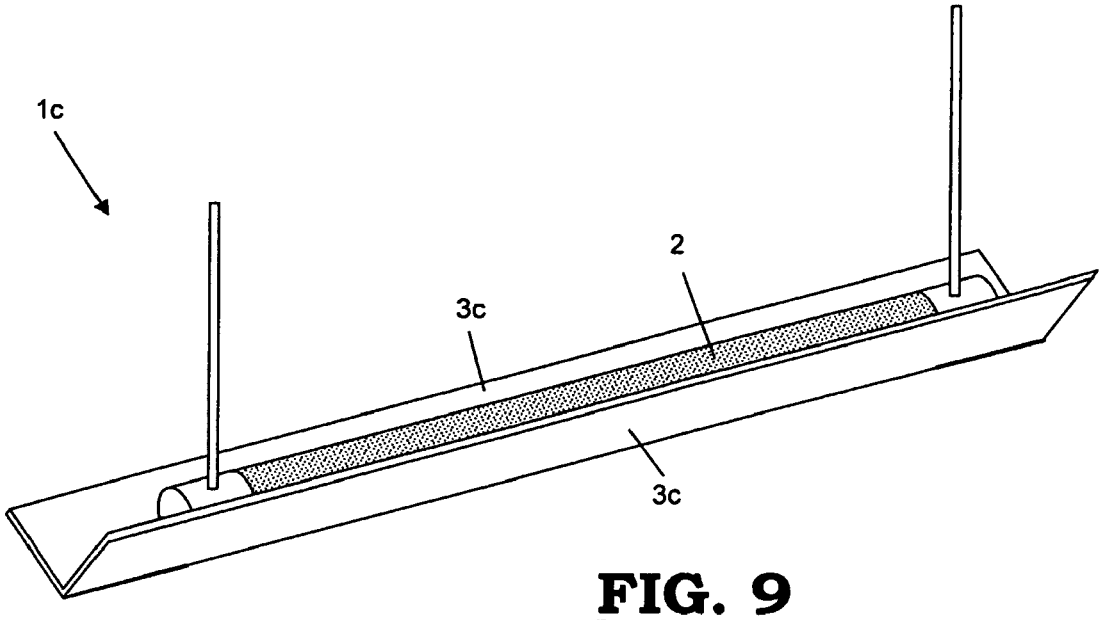
FIG. 9 is a third exemplary embodiment of a lighting device according to the invention, in a non-active state.
Figure 10:
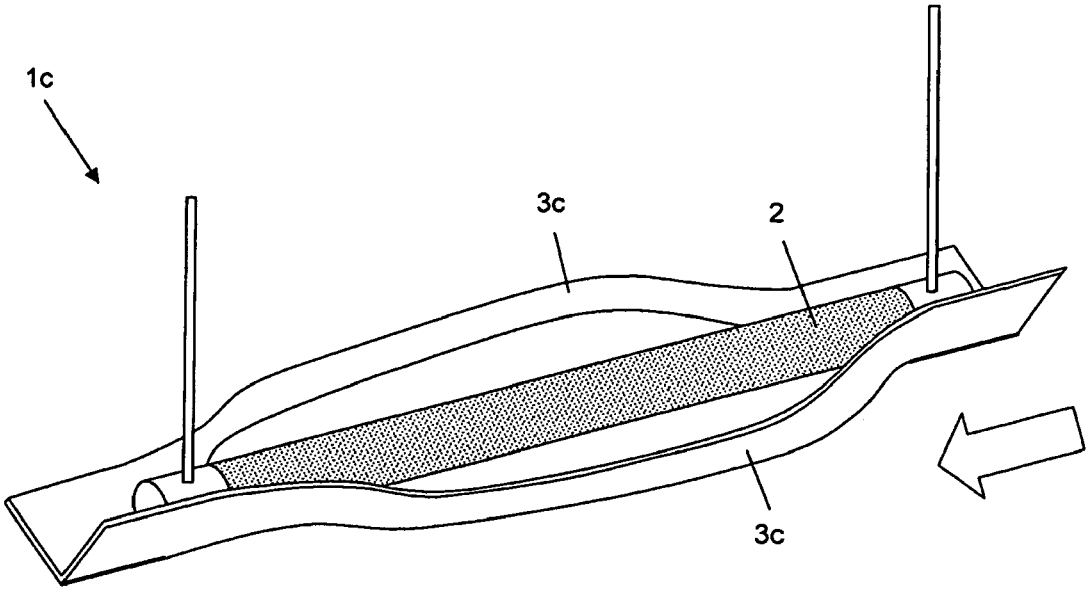
FIG. 10 is a third exemplary embodiment of a lighting device according to the invention, in an active state.

In FIGS. 9 and 10 the lighting device (1*c*) is a suspended lighting fitting provided with one light source (2) of the type described in example 1. The deformable housing elements (3*c*) are two longitudinal strips disposed in a V shape, which strips are partially connected to each other at both ends and laterally enclose the light source (2). Since the pressure-resistant (rigid) tube (2*a*) is connected to the longitudinal strips (3*c*) at the end where the actuator (4*a*) is situated, and said longitudinal strips (3*c*) are connected to each other at both ends in a partial V shape, pressure can be exerted with an actuator (4*a*) upon the deformable housing elements, so that the latter are bent outwards, with the result that the light source (21) can be seen better and in a different way.

Example 4

Figure 13:
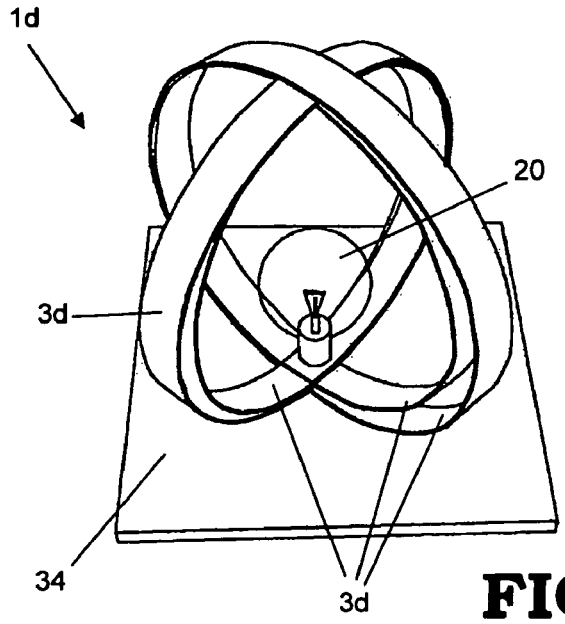
FIG. 13 is a fourth exemplary embodiment of a lighting device according to the invention, in a non-active state.
Figure 14:
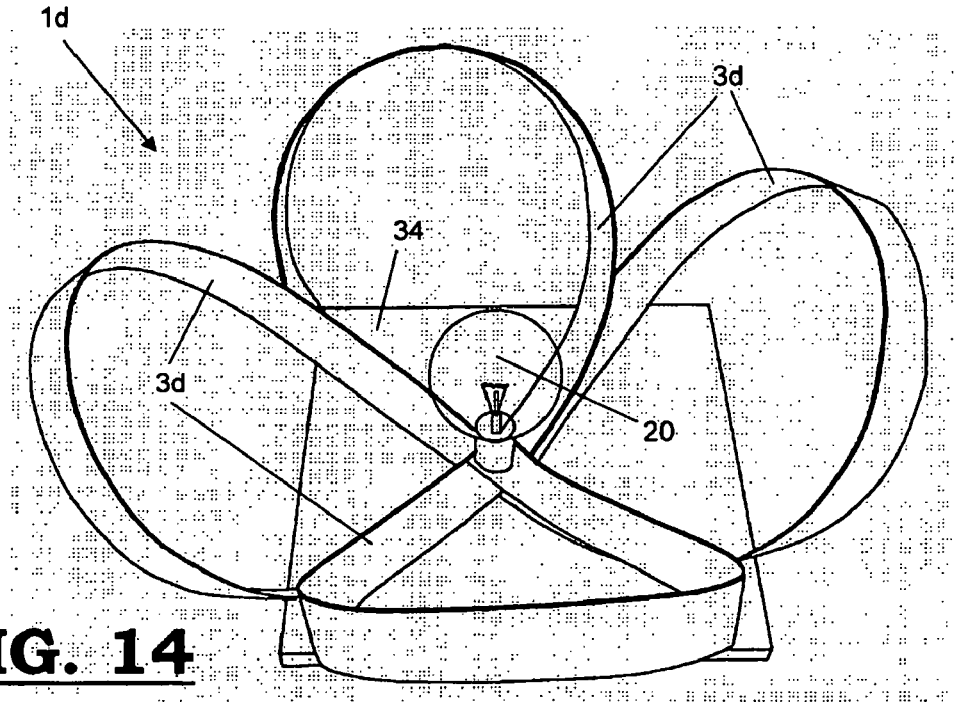
FIG. 14 is a fourth exemplary embodiment of a lighting device according to the invention, in an active state.

In FIGS. 13 and 14 the lighting device (1*d*) is a standing lighting fitting provided with one light source (21), for example of the incandescent lamp or halogen lamp type. The deformable housing elements (3*d*) are four looped strips overlapping each other at the bottom by the width of the strip (3*d*), and decreasing slightly in size towards the inside, so that they can swing away from each other. One end of each looped strip (3*d*) in each case is fixed to a base (34), and the other overlapping end can rotate 90°. In the closed state the strips (3*d*) are situated in pairs at right angles to each other, and the light source (21) that is on the axis of rotation is partially enclosed. By means of a rotating movement arising through use of an actuator (4*b*) of the type shown in FIGS. 11 and 12, this rotation can be converted into a rotating and deforming movement of the housing elements (3*d*), so that said housing elements (3*d*) are bent outwards, with the result that the light source (21) can be seen better and in a different way.

The invention claimed is:

1. Lighting device (1*a*, 1*b*, 1*c*, 1*d*), comprising at least one light source (2, 21); and one or more deformable housing elements (3) made of an essentially non-transparent material, said housing elements being movable relative to said light source(s) (2, 21), the movement of the said housing elements (3) being achieved by means of deformation of said housing elements (3); wherein the deformation of one or more housing elements (3) is controlled by means of one or more actuators (4*a*, 4*b*).

2. Lighting device according to claim 1, wherein one or more power sources are provided for activating the actuator (s), and for switching on the one or more light sources (2, 21), said one or more power sources being the same.

3. Lighting device according to claim 1, characterized in that one or more power sources are provided for activating the actuator(s) (4*a*, 4*b*), and for switching on the one or more light sources (2, 21), said one or more power sources being different.

4. Lighting device according to claim 3, characterized in that the one or more power sources that are provided for activating the said actuator(s) (4*a*, 4*b*) are put into operation at a set time.

5. Lighting device according to claim 1, wherein the one or more actuators (4*a*, 4*b*) are provided for performing a return movement of the one or more housing elements (3*a*, 3*b*, 3*c*, 3*d*) to their original shape.

6. Lighting device according to claim 5, wherein a spring system, a counterweight or a magnetic system is provided in order to support the return movement of the said one or more housing elements (3*a*, 3*b*, 3*c*, 3*d*).

7. Lighting device according to claim 1, wherein the one or more actuators (4*a*, 4*b*) are provided for performing a 2-dimensional and/or 3-dimensional movement, the 2-dimensional and/or 3-dimensional movement of the one or more actuators (4*a*, 4*b*) producing a 2-dimensional or 3-dimensional deformation of the one or more housing elements (3*a*, 3*b*, 3*c*, 3*d*).

8. Lighting device according to claim 1, wherein the one or more actuators are selected from thermal actuators, pneumatic actuators, hydraulic actuators, three-dimensional actuators, electric motors, step motors, piezoelectric translators or linear actuators.

9. Lighting device according to claim 8, wherein if thermal actuators (4*a*, 4*b*) are provided, a mechanism leaving some space for motion is provided for preventing premature deformation of the one or more housing elements (3*a*, 3*b*, 3*c*, 3*d*) by a premature movement of the one or more actuators (4*a*, 4*b*) by means of environmental heat.

10. Lighting device according to claim 8, wherein the thermal actuators (4*a*, 4*b*) are of the wax motor type.

11. Lighting device according to claim 1, wherein the lighting device is of the type built-in lighting fitting, standing lighting fitting, suspended lighting fitting or floating lighting fitting.

12. Lighting device comprising at least one light source (2, 21); and one or more housing elements (3), said housing elements being movable relative to said light source(s) (2, 21), the movement of the said housing elements (3) being achieved by means of deformation of said housing elements (3); wherein the deformation of one or more housing elements (3) is controlled by means of one or more actuators (4*a*, 4*b*), and wherein one or more power sources are provided for activating the one or more actuators, and for switching on the one or more light sources (2, 21), said one or more power sources being the same, and wherein a relay is provided for the actuator(s) (4*a*, 4*b*) to go into operation a certain time before or after activation of the actuator(s) (4*a*, 4*b*).

13. Lighting device comprising at least one light source (2, 21); and one or more housing elements (3), said housing elements being movable relative to said light source(s) (2, 21), the movement of the said housing elements (3) being achieved by means of deformation of said housing elements (3), wherein the deformation of one or more housing elements (3) is controlled by means of one or more actuators (4*a*, 4*b*), and wherein one or more power sources are provided for activating the one or more actuators (4*a*, 4*b*), and for switching on the one or more light sources (2, 21), said one or more power sources being different, and wherein the one or more power sources that are provided for activating the said actuator(s) (4*a*, 4*b*) are put into operation at a set time, and wherein the putting into operation of the one or more power sources that are provided for activation of the said actuator(s) (4*a*, 4*b*) is performed according to a certain preset cycle.

14. Lighting device comprising at least one light source (2, 21); and one or more housing elements (3), said housing elements being movable relative to said light source(s) (2, 21), the movement of the said housing elements (3) being achieved by means of deformation of said housing elements (3), wherein the deformation of one or more housing elements (3) is controlled by means of one or more actuators (4*a*, 4*b*), and wherein the one or more housing elements (3*a*, 3*b*, 3*c*, 3*d*) are made of a material that has the property that it automatically at least partially returns to its original shape after deformation.

15. Lighting device comprising at least one light source (2, 21); and one or more housing elements (3), said housing elements being movable relative to said light source(s) (2, 21), the movement of the said housing elements (3) being achieved by means of deformation of said housing elements (3), wherein the deformation of one or more housing elements (3) is controlled by means of one or more actuators (4*a*, 4*b*), and wherein a plurality of actuators (4*a*, 4*b*) is provided in order to

- reinforce a certain deformation of the one or more housing elements (3*a*, 3*b*, 3*c*, 3*d*) by increasing the force of the actuator(s) (4*a*, 4*b*); and/or
- make the deformable housing elements deform over a greater distance by, for example, connecting various actuators (4*a*, 4*b*) to each other in series; and/or
- deform one or more of the housing elements of the lighting device in order to obtain a tilting moment that causes a series of connected housing elements to deform; and/or
- lock and unlock a certain position of the housing elements (3*a*, 3*b*, 3*c*, 3*d*); and/or
- harmonize the deformation of the housing elements (3*a*, 3*b*, 3*c*, 3*d*); and/or
- make the deformation cycles of the various housing elements (3*a*, 3*b*, 3*c*, 3*d*) run according to their own rhythm.

* * * * *